US005890960A

United States Patent [19]

Cronan et al.

[11] Patent Number: 5,890,960

[45] Date of Patent: Apr. 6, 1999

[54] VENTING SYSTEM FOR STRUCTURES USING A RIDGE VENT

[75] Inventors: Max D. Cronan, Kingston; Louis B. Hale, Crossville, both of Tenn.

[73] Assignee: Randall H. Fisher, Cleveland, Tenn.

[21] Appl. No.: 921,168

[22] Filed: Aug. 29, 1997

[51] Int. Cl.[6] ..... F24F 7/02

[52] U.S. Cl. ..... 454/365; 4/218

[58] Field of Search ..... 454/3, 35, 364, 454/365, 366, 367, 368; 4/218

[56] References Cited

U.S. PATENT DOCUMENTS

| | | | |
|---|---|---|---|
| 4,782,743 | 11/1988 | Quinnell | 454/365 |
| 5,390,451 | 2/1995 | Kopp et al. . | |
| 5,394,663 | 3/1995 | Jackson | 454/366 X |
| 5,457,920 | 10/1995 | Waltz . | |
| 5,487,247 | 1/1996 | Pigg . | |
| 5,561,953 | 10/1996 | Rotter . | |
| 5,615,526 | 4/1997 | Palmer et al. . | |

*Primary Examiner*—Harold Joyce
*Attorney, Agent, or Firm*—Pitts & Brittian, P.C.

[57] ABSTRACT

A venting system for structures using a ridge vent for venting a conventional exhaust system associated with a structure through a conventional ridge vent. The venting system includes a ridge vent adaptor, which defines a mounting head at an upper end, and a pipe coupling at a lower end. The mounting head is configured to be received through an opening formed in the ridge of the roof. The mounting head defines two mounting flaps for securing the ridge vent adaptor to the roof of the structure. The mounting flaps are dimensioned to be concealed by the ridge vent when installed. The pipe coupling is provided for coupling a conventional pipe of an exhaust system into the ridge vent adaptor. A transition portion is defined between the mounting head and the pipe coupling, and is continuously increasing in cross-sectional area from the pipe coupling to the mounting head such that outlet of exhaust gases is not inhibited. Flexible pipe connectors are provided for adapting an existing exhaust system to the ridge vent adaptor of the present invention. Each flexible pipe connector is provided with a female receptor at one end and either a female receptor or a male connector at the other end, with an accordion-style elongated body, and is capable of flexing at least 135° in any direction with respect to the central axis thereof. As a function of the flexible pipe connectors, a pipe connecting the two flexible pipe connectors is oriented at an angle equal to that of the roof pitch.

19 Claims, 10 Drawing Sheets

VENTING SYSTEM FOR STRUCTURES USING A RIDGE VENT

TECHNICAL FIELD

This invention relates to the field of building construction. More specifically, the present invention relates to an apparatus for assisting in ventilating various exhaust systems through a ridge vent in the structure, thereby obviating the need for upstanding pipes extending through the roof of the structure.

BACKGROUND ART

In the field of building construction, it is well known that exhaust systems such as a sewer exhaust and a room exhaust, are vented through the roof of the building. This is true whether the structure is a commercial building or a residential house. Most building codes require that the upstanding pipes rise to a particular level above the roof in order to prevent the exhausted gases from re-entering the structure. However, as a result of the venting of the particular exhaust system through the roof, several problems arise. Namely, each opening cut into the roof of the structure for passage of an upstanding pipe presents a potential for leaks. Many devices have been developed for the reduction of leaks around such pipes. Another problem associated with upstanding pipes is a reduction in the aesthetic quality of the structure.

It is also well known that in many structures today, ridge vents are utilized for venting the structure, and especially the attic. Although most commonly used for buildings with A-frame roofs, any slanted roof may incorporate a ridge vent to assist in circulating air through the structure. Due to the nature of the ridge vent, the ridge vent is disposed at the high point on the roof, thereby exhausting heated air as it rises.

Other devices have been produced to assist in ventilating exhaust systems through the roof of the structure, and to prevent leaks around upstanding pipes, flashing, and other components associated with the exhaust system. Typical of the art are those devices disclosed in the following U.S. Patents:

| U.S. Pat. No. | Inventor(s) | Issue Date |
|---|---|---|
| 4,782,743 | G. C. Quinnell | Nov. 8, 1988 |
| 5,390,451 | R. A. Kopp, et al. | Feb. 21, 1995 |
| 5,394,663 | J. Jackson | Mar. 7, 1995 |
| 5,457,920 | D. A. Waltz | Oct. 17, 1995 |
| 5,487,247 | W. L. Pigg | Jan. 30, 1996 |
| 5,561,953 | M. J. Rotter | Oct. 8, 1996 |
| 5,615,526 | D. W. Palmer, et al. | Apr. 1, 1997 |

Of these, those patents issued to Waltz ('920) and Rotter ('953) each disclose ridge vent constructions for roofs. The '920 device is a ridge vent for a conventional shingled roof, with flexible teeth adapted to fit between shingles to prevent passage of debris thereunder. The '953 device is provided for venting the ridge of a contoured metal roof. Neither of these devices teaches the use of the ridge vent for exhausting a conventional exhaust system such as that associated with a plumbing vent.

Those devices disclosed by Kopp, et al. ('451); Jackson ('663); and Palmer, et al. ('526) are illustrative of those devices which require cutting an opening in the roof as discussed above. It is evident from the disclosures of each that leaking around these devices is of concern, in that seals, gaskets, and waterproofing membranes are disclosed. The '663 device is a pipe flashing vent requiring the formation of an opening in the roof, and is configured to assist in preventing water from entering a pipe associated with an exhaust system in the structure. The '663 device is provided for venting the exhaust system wherein the upstanding pipe terminates within the structure. Although this device reduces the negative impact to the aesthetic quality of a conventional upstanding pipe, such problem is not eliminated. Further, the concerns regarding leaking around the stand pipe are not alleviated. The '451 device is a flexible high collar roof flashing for sealing an opening in a roof through which an upstanding pipe extends. The '526 device is a drain for draining water from a flat roof.

Pigg ('247) discloses a ventilation system for a roof and wall structure, wherein direct ventilation is accomplished through the walls and roof. Air vented through the structure is directed to at least one vent pipe extending above the apex of the roof The '247 device is not provided with means for venting through a ridge vent. Nor is the '247 device provided with a means for communication exhaust gas from within a discrete system in the structure to the exterior of the structure.

The device disclosed by Quinnell ('743) is a ridge tile with a ventilating aperture. A cap is taught for preventing water from entering the ventilating aperture. The '743 device is provided specifically for use with tile roofs, and cannot be used with conventional ridge vents. Specifically, the '743 device includes a ventilation duct which extends through the roof and into the weather cap.

Therefore, it is an object of this invention to provide a means for venting a conventional exhaust system associated with a structure through a conventional ridge vent disposed at a high point on the roof of the structure.

It is another object of the present invention to provide a means whereby the device may be quickly installed whether in a newly constructed building or as a retrofit to existing structures.

Another object of the present invention is to provide such a device whereby all stand pipes associated with the structure are eliminated, thereby improving the integrity of the roof of the structure and improving the aesthetic value of the roof.

Still another object of the present invention is to provide a means whereby an exhaust system within a structure may be easily adapted to be vented through the ridge vent without requiring manipulation of cumbersome plumbing components.

DISCLOSURE OF THE INVENTION

Other objects and advantages will be accomplished by the present invention which serves to vent a conventional exhaust system associated with a structure through a conventional ridge vent disposed at a high point on the roof of the structure. The venting system is designed for use with various types of exhaust systems, and is designed to be used as a retrofit to an existing structure, or for installation during construction of a new structure. Further, the venting system of the present invention is designed to be easily installed without the assistance of a professional plumber. By utilizing the ridge vent of a structure, the venting system of the present invention eliminates the need for openings cut into the roof of the structure for the passage of a standpipe or other vent, and the disadvantages associated therewith.

The primary component of the venting system is a ridge vent adaptor. When the venting system of the present invention is used in association with a room fan or a oven/stove exhaust system, the preferred material of fabrication is sheet metal. When the venting system is used with a sewer vent, however, the preferred material of fabrication is plastic in order to prevent leaks through seams. However, any conventional material may used for appropriate application of the present invention.

The ridge vent adaptor defines a mounting head at an upper end, and a pipe coupling at a lower end. The mounting head is configured to be received through an opening formed in the ridge of the roof. The mounting head defines two mounting flaps for securing the ridge vent adaptor to the roof of the structure. The mounting flaps define a plurality of openings for receipt of conventional fasteners such as roofing nails for securement thereof to the roof. The mounting flaps are dimensioned to be concealed by the ridge vent when installed. In order to conform to roofs of various pitches, the mounting flaps of the preferred embodiment are flexible along the top edge of the mounting head. The pipe coupling is provided for coupling a conventional pipe of an exhaust system into the ridge vent adaptor and defines an inner shoulder for abutting a pipe end thereto. When the pipe is cemented into the pipe coupling, the inner shoulder provides a surface for forming a seal between the pipe coupling and the pipe.

Because the mounting head defines a rectangular configuration, and the pipe coupling defines a circular configuration, a transition portion is defined. The transition portion is continuously increasing in cross-sectional area from the pipe coupling to the mounting head such that outlet of exhaust gases is not inhibited.

The ridge vent adaptor of the present invention is fabricated in either a one piece construction for use with a building under construction (prior to the construction of the roof) or in a two piece construction to retrofit an existing structure. In the two-piece construction, the transition portion defines an extension configured to be closely received within the mounting head. The extension is secured within the mounting head in a conventional manner upon installation of the mounting head.

In order to adapt an existing exhaust system to the ridge vent adaptor of the present invention, the venting system of the present invention is provided with flexible pipe connectors. Each flexible pipe connector is provided with a coupler at each end and an accordion-style elongated body, and is capable of flexing at least 135° in any direction with respect to the central axis thereof Each flexible pipe connector includes a female receptor at one end and either a female receptor or a male connector at the other end. As a function of the flexible pipe connectors, a pipe connecting the two flexible pipe connectors is oriented at an angle equal to that of the roof pitch.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
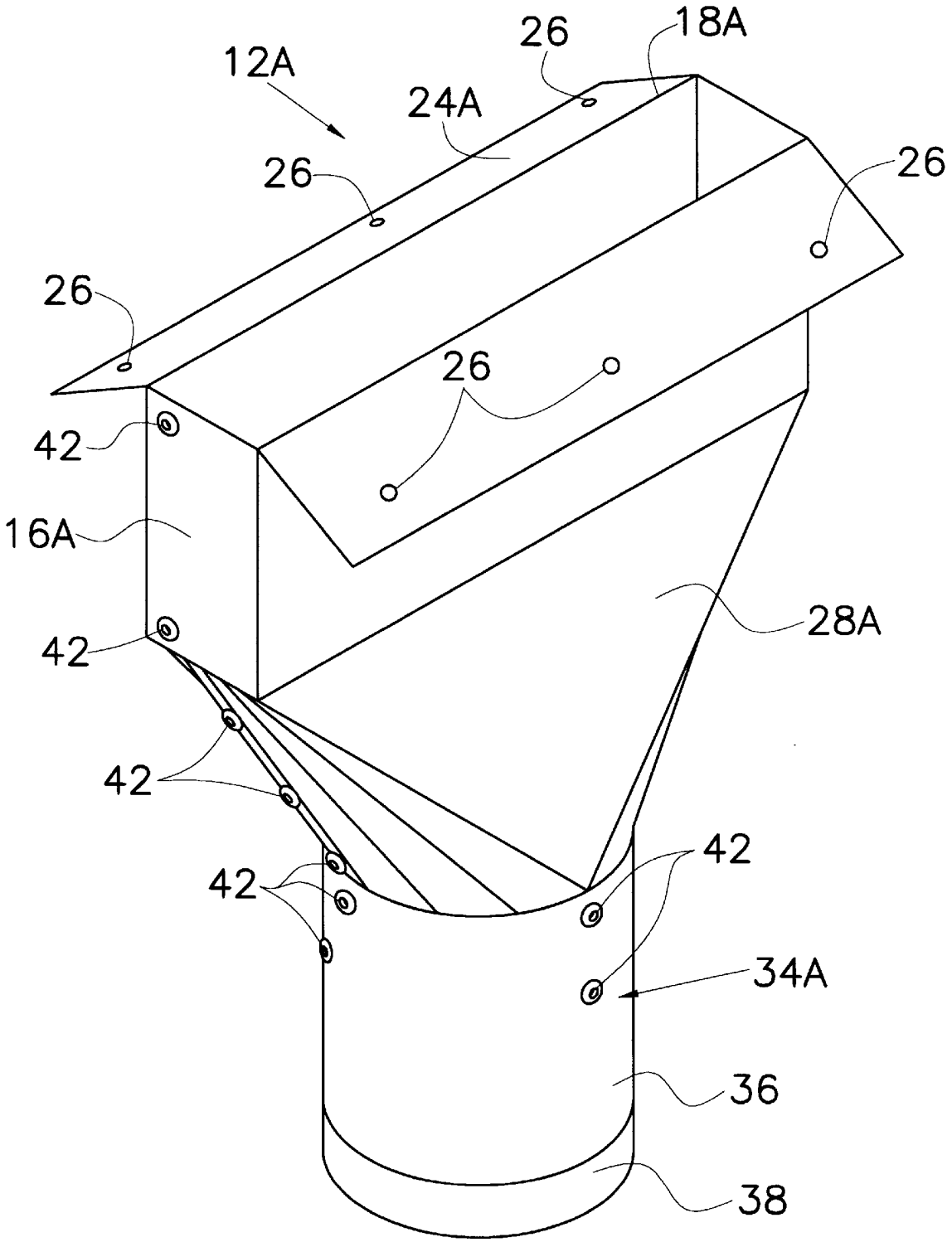
FIG. 1 is a perspective view of a ridge vent adaptor constructed in accordance with several features of the present invention, wherein the ridge vent adaptor is fabricated from metal in a one-piece unit for installation in new construction.

A venting system for structures using a ridge vent incorporating various features of the present invention is illustrated generally at 10 in the figures. The venting system for structures using a ridge vent, or venting system 10, is designed for venting a conventional exhaust system 64 associated with a structure through a conventional ridge vent 62 disposed at a high point on the roof 58 of the structure 56. Moreover, the venting system 10 is designed for use with various types of exhaust systems 64, and is designed to be used as a retrofit to an existing structure 56, or for installation during construction of a new structure 56. Further, the venting system 10 of the present invention is designed to be easily installed without the assistance of a professional plumber. By utilizing the ridge vent 62 of a structure 56, the venting system 10 of the present invention eliminates the need for openings cut into the roof 58 of the structure 56 for the passage of a standpipe or other vent, and the disadvantages associated therewith.

Figure 2:
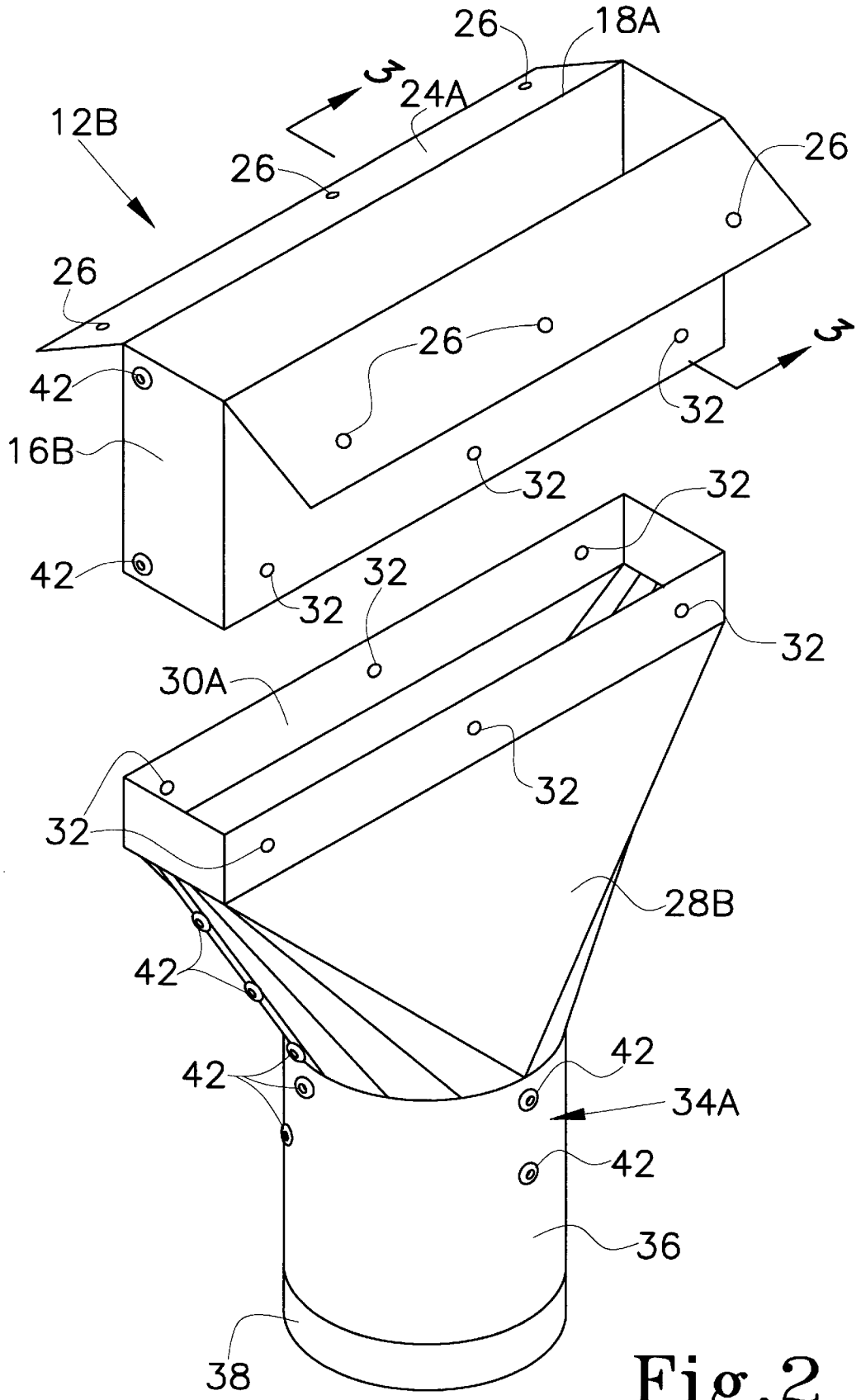
FIG. 2 is a perspective view of an alternate embodiment of the ridge vent adaptor using a two piece construction typically for use in retrofitting an existing structure.
Figure 3:
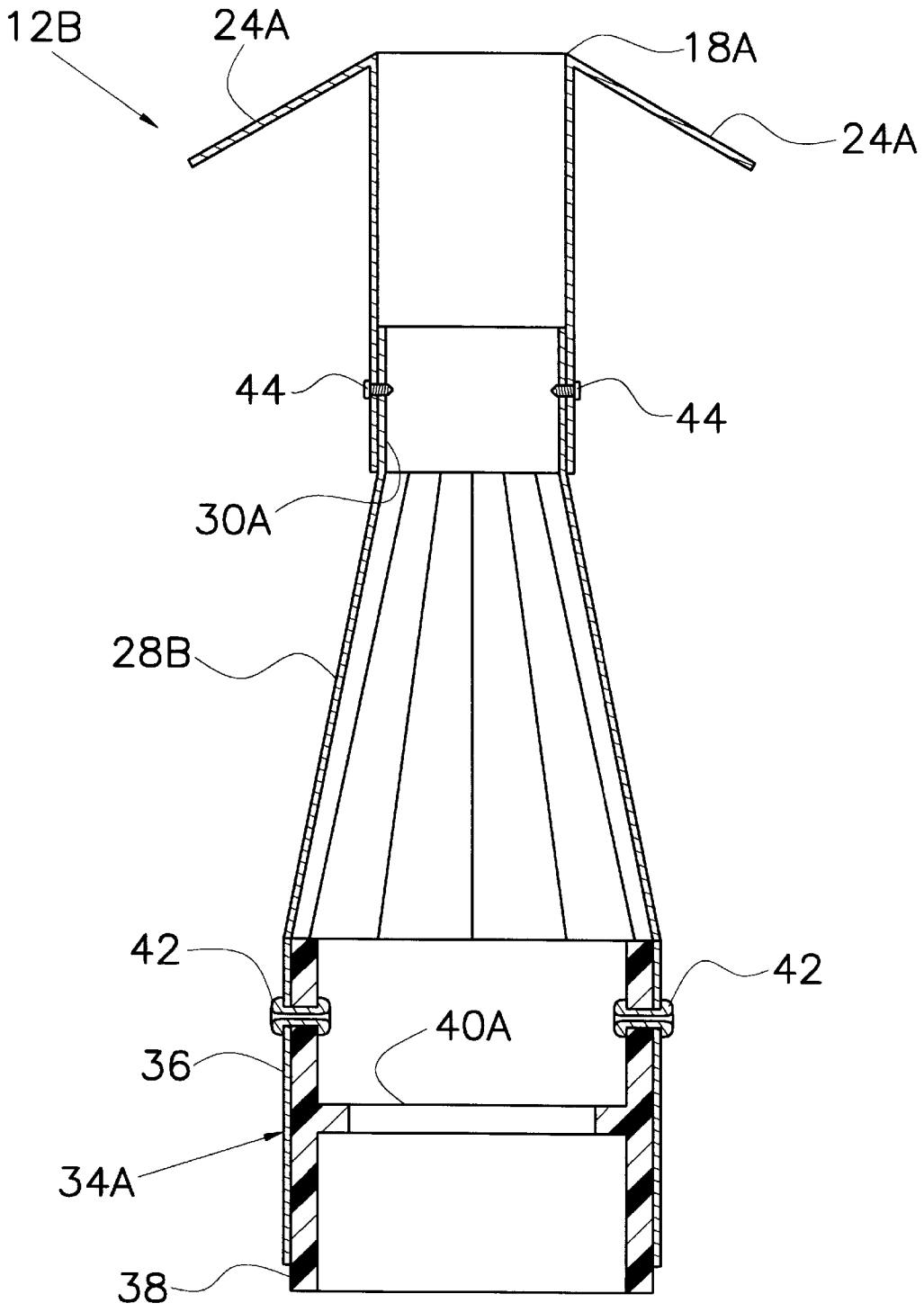
FIG. 3 is an elevation view, in section taken at 3—3 of FIG. 2, illustrating the assembled ridge vent adaptor of FIG. 2.
Figure 4:
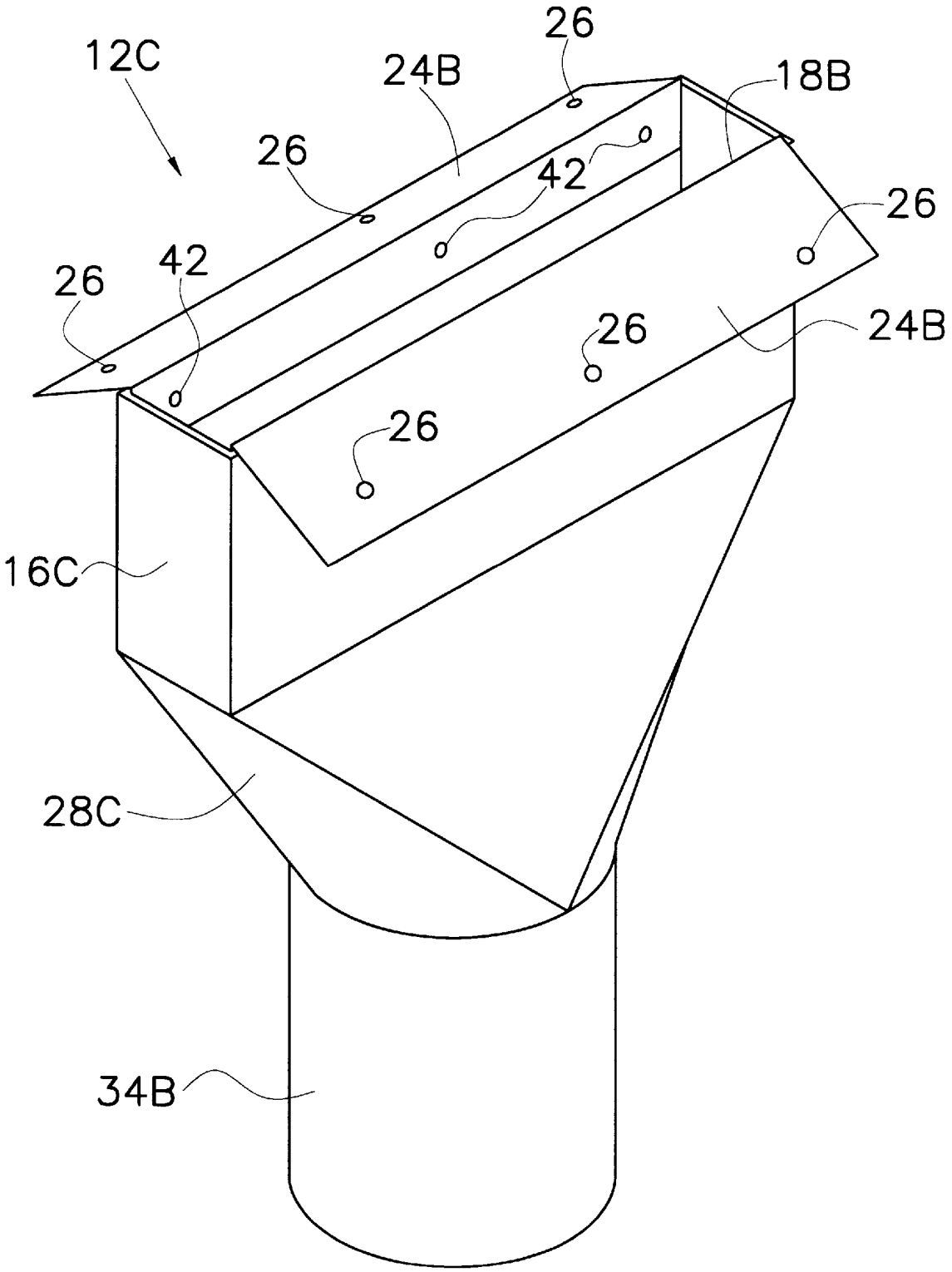
FIG. 4 is a perspective view of a further alternate embodiment of the a ridge vent adaptor constructed in accordance with several features of the present invention, wherein the ridge vent adaptor is fabricated from plastic in a one-piece unit for installation in new construction.
Figure 5:
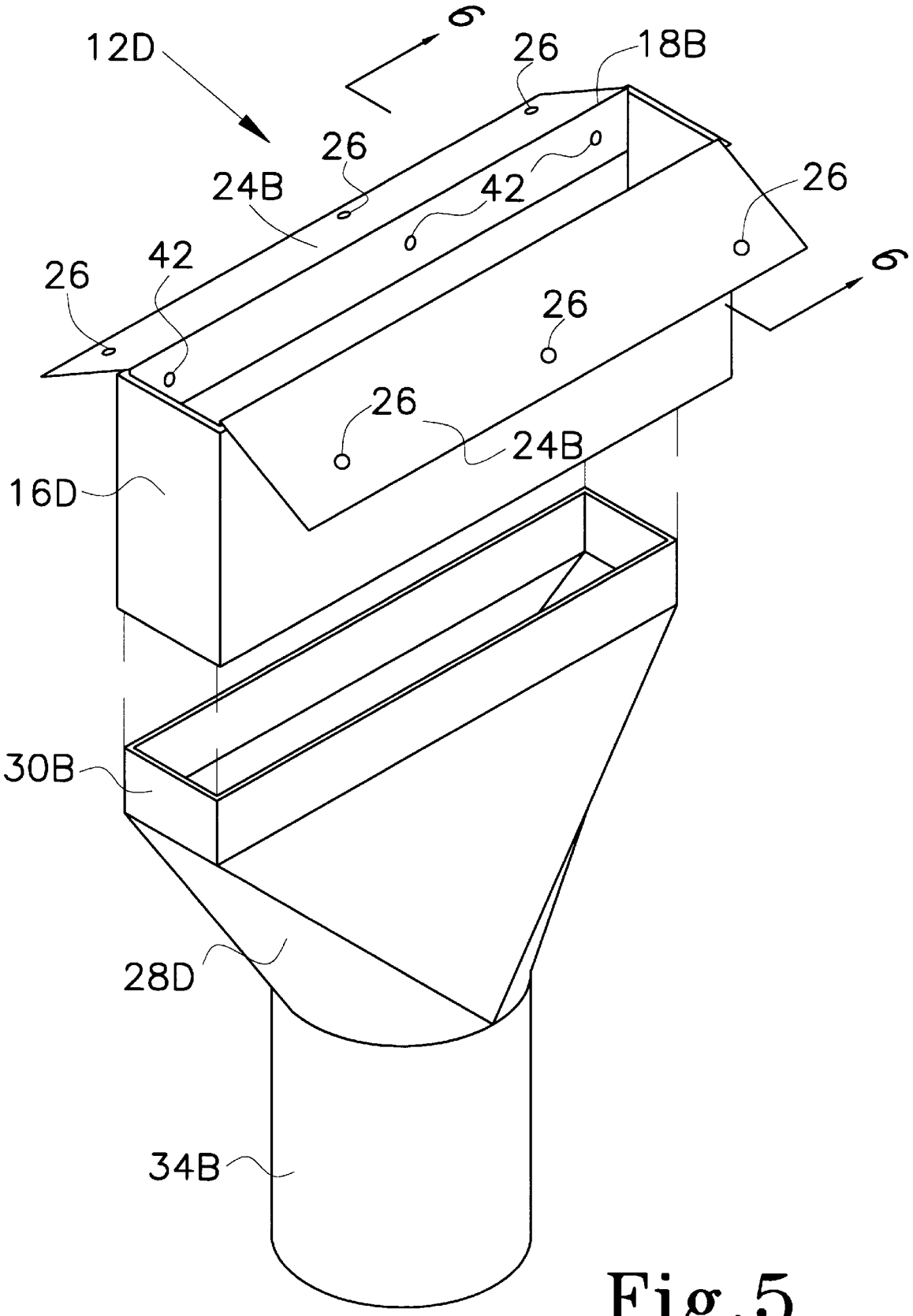
FIG. 5 is a perspective view of still another alternate embodiment of the ridge vent adaptor using a two piece construction typically for use in retrofitting an existing structure.
Figure 6:
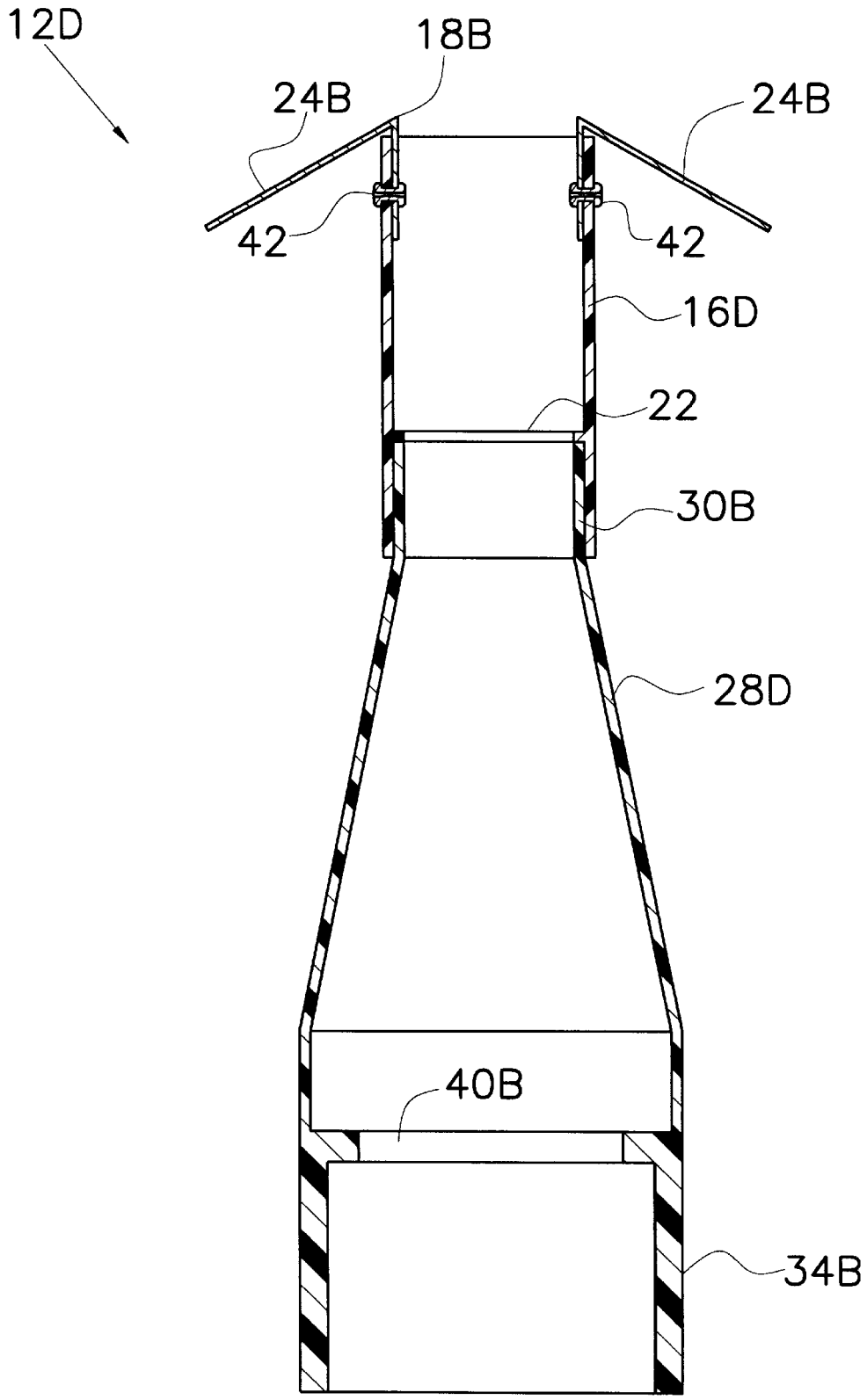
FIG. 6 is an elevation view, in section taken at 6—6 of FIG. 5, illustrating the assembled ridge vent adaptor of FIG. 5.

As illustrated in FIGS. 1 through 6, the primary component of the venting system 10 is a ridge vent adaptor 12. In the preferred embodiments, the ridge vent adaptor 12 is fabricated from either sheet metal or plastic. It will be understood that any other material of fabrication may be used as well, with equal success. However, it will be understood that the material of fabrication is to be selected dependant upon the exhaust system 64 with which the present invention is to be used. For example, when the venting system 10 of the present invention is used in association with a room fan or a oven/stove exhaust system, the preferred material of fabrication is sheet metal, as illustrated in FIGS. 1–3. When the venting system 10 is used with a sewer vent, however, the preferred material of fabrication is plastic, as illustrated in FIGS. 4–6, in order to prevent leaks through seams. Of course, with the principal concern with preventing leaks in the latter situation, it will be understood that any suitable material of fabrication may be used with appropriate measures being taken to prevent leaks, such as by sealing all seams with, for example, silicon caulking.

The ridge vent adaptor 12 defines a mounting head 16 at an upper end, and a pipe coupling 34 at a lower end. The mounting head 16 is configured to be received through an opening 60 formed in the ridge of the roof 58. In construction, it is known to those skilled in the art that a standard two inches (2") opening is constructed at the ridge of the roof 58 in order to accomplish proper venting through a conventional ridge vent. It is also known to those skilled in the art that a standard spacing of roof trusses is twenty four inches (24"), on center. Therefore, for standard construction, openings along the ridge of a roof 58 are approximately 2" by approximately 22½". Accordingly, the mounting head 16 is dimensioned to fit within an opening of these dimension. In the preferred embodiment, the length of the mounting head 16 is approximately 10" in order to allow for ventilation from the attic of the structure 56 around each side of the ridge vent adaptor 12 and through the ridge vent 62. However, it will be understood that the critical dimensions of the mounting head 16 are a function of the required volume of gas flow through the ridge vent adaptor 12, and that the present invention is not intended to be limited to any particular dimensions. The mounting head 16 defines two mounting flaps 24 for securing the ridge vent adaptor 12 to the roof 58 of the structure 56. The mounting flaps 24 define a plurality of openings 26 for receipt of conventional fasteners 46 such as roofing nails for securement thereof to the roof 58. The mounting flaps 24 are dimensioned to be concealed by the ridge vent 62 when installed. In order to conform to roofs 58 of various pitches, the mounting flaps 24 of the preferred embodiment are flexible along the top edge 18 of the mounting head 16. Therefore, one standard mounting head 16 may be used for any roof 58, regardless of the roof pitch.

The pipe coupling 34 is provided for coupling a conventional pipe 66 of an exhaust system 64 into the ridge vent adaptor 12. The pipe coupling 34 defines an inner shoulder 40 for abutting a pipe end thereto. When the pipe 66 is cemented into the pipe coupling 34, the inner shoulder 40 provides a surface for forming a seal between the pipe coupling 34 and the pipe 66. The pipe coupling 34 defines an interior diameter to properly couple a pipe 66 having a selected outside diameter, Thus it will be seen that various sizes of the pipe coupling 34 may be employed to adapt to various sizes of pipes 66 associated exhaust systems 64.

Because the mounting head 16 defines a rectangular configuration, and the pipe coupling 34 defines a circular configuration, a transition portion 28 is defined. In the preferred embodiment, the transition portion 28 is continuously increasing in cross-sectional area from the pipe coupling 34 to the mounting head 16 such that the flow of exhaust gases from the exhaust system 64 is not inhibited. It will be understood that the cross-sectional area defined by the mounting head 16 must be at least equal to that of the pipe coupling 34.

Referring specifically to FIG. 1, one illustrated embodiment of the ridge vent adaptor 12A is fabricated from sheet metal in a one-piece construction. This embodiment is specifically designed for new construction, wherein the ridge vent adaptor 12A is installed during construction of the roof 58. Each of the mounting head 16A, the transition portion 28A, and the pipe coupling 34A are formed from individual pieces of sheet metal and conventional fasteners 42 such as rivets. The individual sections are then fastened together to define a single unit using conventional fasteners 42. The pipe coupling 34A in the illustrated embodiment includes a sleeve 36 fabricated from sheet metal as described and a coupling insert 38 fabricated from plastic in order to accomplish coupling with a conventional pipe 66 as described above. The coupling insert 38 is secured to the pipe coupling sleeve 36 using similar convention conventional fasteners 42, also as described above.

The embodiment illustrated in FIGS. 2 and 3 is an adaptation of that of FIG. 1 with the exception that the mounting head 16B is removable from the transition portion 28B of the ridge vent adaptor 12B. This embodiment is designed specifically for retrofitting an existing structure 56, but may be used in new construction as well. To install this embodiment of the ridge vent adaptor 12B, the mounting head 16B is dropped into an opening 60 formed in the ridge of the roof 58 and the transition portion 28B is inserted into the mounting head 16B from within the attic of the structure 56. To this extent, the transition portion 28B defines an extension 30A configured to be closely received within the mounting head 16B. A plurality of cooperating openings 32 is defined to allow for the reception of conventional fasteners 44 such as sheet metal screws or rivets.

The ridge vent adaptor 12C illustrated in FIG. 4 is a one-piece construction intended for use in new construction, in similar fashion to the embodiment of FIG. 1. The illustrated embodiment of FIG. 4 is fabricated from a plastic to avoid leaks through seams therein. Mounting flaps 24B are illustrated as being separately formed and mounted within the mounting head 16C. To this extent, the mounting flaps 24B may be fabricated from sheet metal, or any other material which provides a greater degree of flexibility than conventional PVC plastic. The mounting flaps 24B are secured using rivets 42, ultrasonic welding, or other conventional fasteners, or may be inserted into a mold during fabrication of the ridge vent adaptor 12C. However, it will also be understood that similar results may be achieved by fabricating the mounting flaps 24B integrally with the mounting head 16C and defining a relief at the top edge 18B of the mounting head 16C.

FIGS. 5 and 6 illustrate a two-piece ridge vent adaptor 12D which is an adaptation of the ridge vent adaptor 12C illustrated in FIG. 4. In similar fashion to the embodiment of FIGS. 2 and 3, this embodiment is configured for use in retrofitting an existing structure 56. As best illustrated in FIG. 6, the mounting head 16D defines an interior shoulder 22 for assisting in forming a seal between the mounting head 16D and the transition portion 28D. To this extent, the transition portion 28D defines an extension 30B dimensioned to be closely received within the mounting head 16D. The preferred connection between the mounting head 16D and the transition portion extension 30B is by gluing with an appropriate plastic adhesive.

Figure 8:
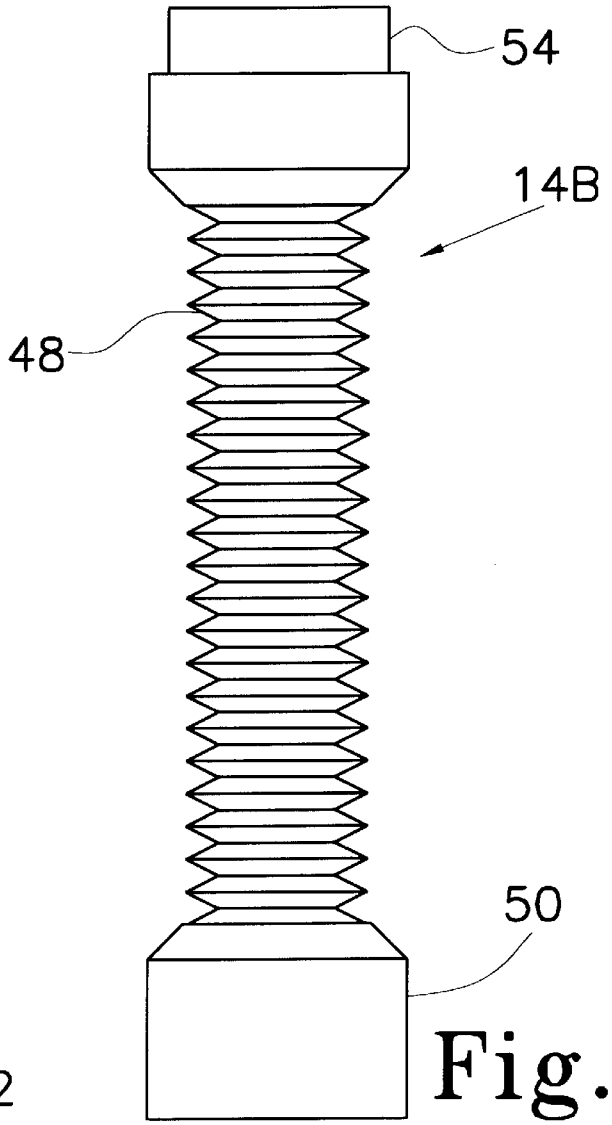
FIG. 8 is an elevation view of a flexible connector pipe having one female adaptor and one male adaptor.
Figure 7:
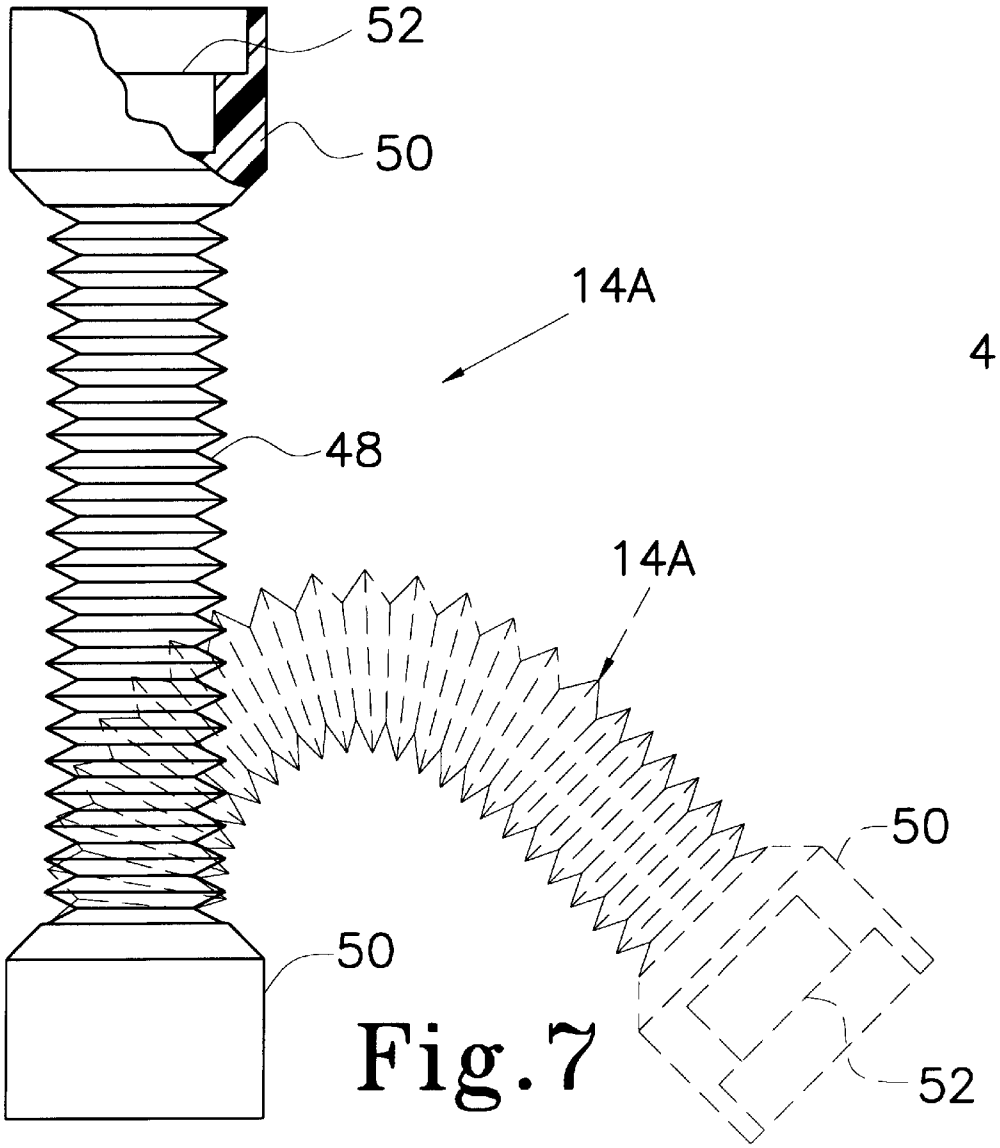
FIG. 7 is an elevation view of a flexible connector pipe having two female adaptors.

In new construction, it is understood by those skilled in the art that piping 66 associated with an exhaust system 64 may be routed to achieve an alignment with the ridge of the roof 58, without complicated turns in the piping 66. However, in existing structures 56, it is known that exhaust systems 64 are provided with stand pipes at a location other than in alignment with the ridge of the roof 58. Finally, it is known to those skilled in the art that standard pipe fittings are not available in the various degrees at which a roof 58 is pitched. Therefore, in order to adapt an existing exhaust system 64 to a ridge vent adaptor 12 of the present invention using standard pipe couplings, complicated arrangements of such pipe couplings must be formed in order to orient a run of pipe 66 at the slope of the roof 58. Thus, a professional is typically required. In order to alleviate this problem, the venting system 10 of the present invention is provided with flexible pipe connectors 14A,B, as illustrated in FIGS. 7 and 8. Each flexible pipe connector 14A,B is provided with an accordion-style elongated body 48, a female receptor 50 disposed at one end thereof, and either a female receptor 50 or a male connecter 54 at the other end thereof As illustrated in FIG. 7, each connector 14A,B is capable of flexing at least 135° in any direction with respect to the central axis thereof.

Figure 10:
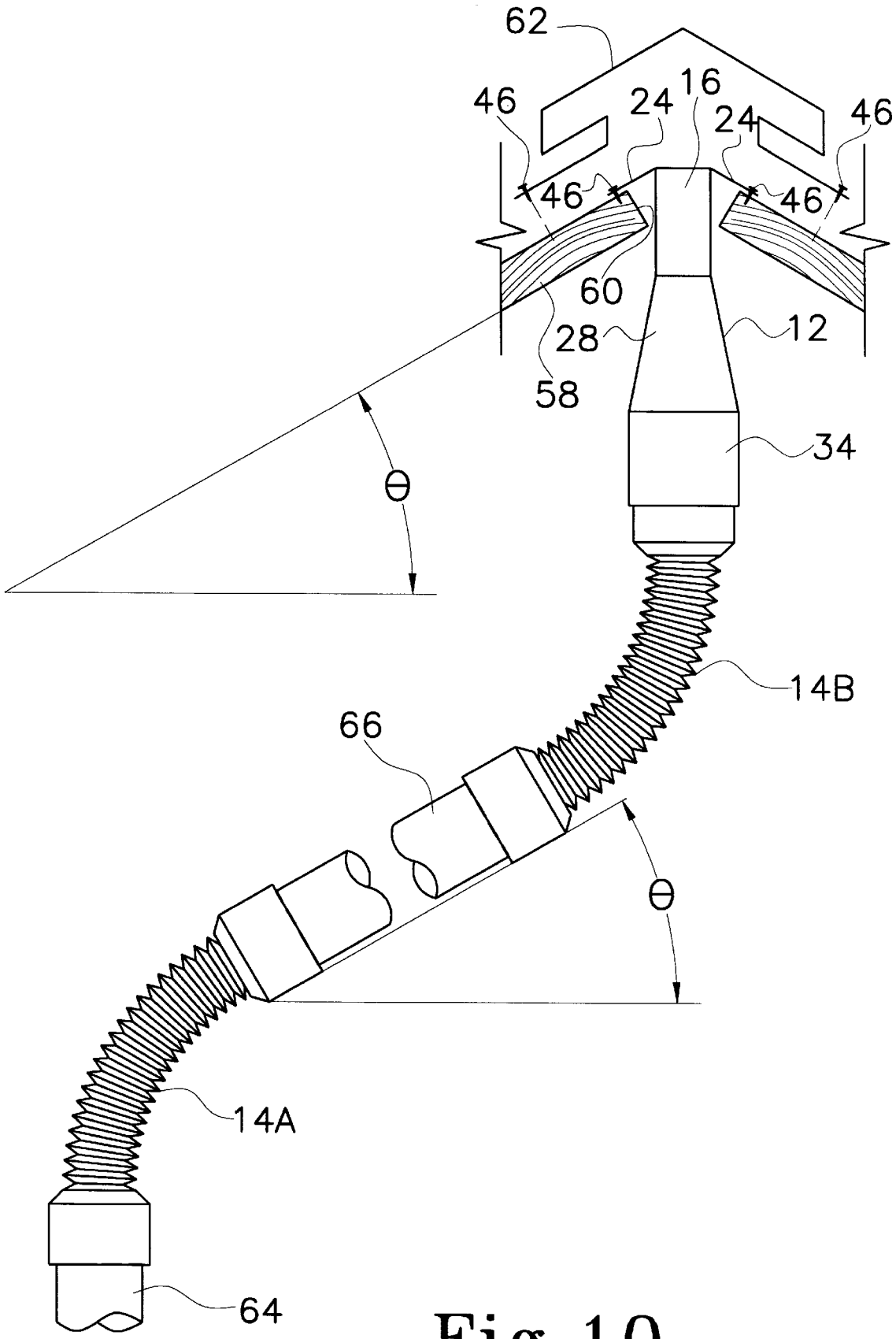
FIG. 10 an adaptor kit for venting an exhaust system in an existing structure through a ridge vent adaptor of the present invention, a connecting pipe being disposed at an angle substantially equal to the pitch of the structure roof.

The embodiment illustrated in FIG. 7 includes a female receptor 50 at each end. Each female receptor 50 defines an internal shoulder 52 for abutting the end of a pipe 66. Thus, as in the previous instances, a surface is provided for developing a seal between the receptor 50 and the pipe 66. In the embodiment of FIG. 8, the flexible pipe connector 14B defines a female receptor 50 at one end and a male connector 54 at the opposite end. Referring to FIG. 10, it will be seen that the flexible pipe connector 14A of FIG. 7 is useful in connecting two pieces of pipe 66, while the flexible pipe connector 14A of FIG. 8 is useful in connecting a piece of pipe 66 to a pipe coupling 34 such as that used in the ridge vent adaptor 12 described above. To this extent, the male connector 54 defines an outer diameter substantially identical to the outside diameter of the pipe 66. Accordingly, the inside diameter of the female connector 50 is dimensioned to closely receive the piece of pipe 66 or the male connector 54.

Figure 9:
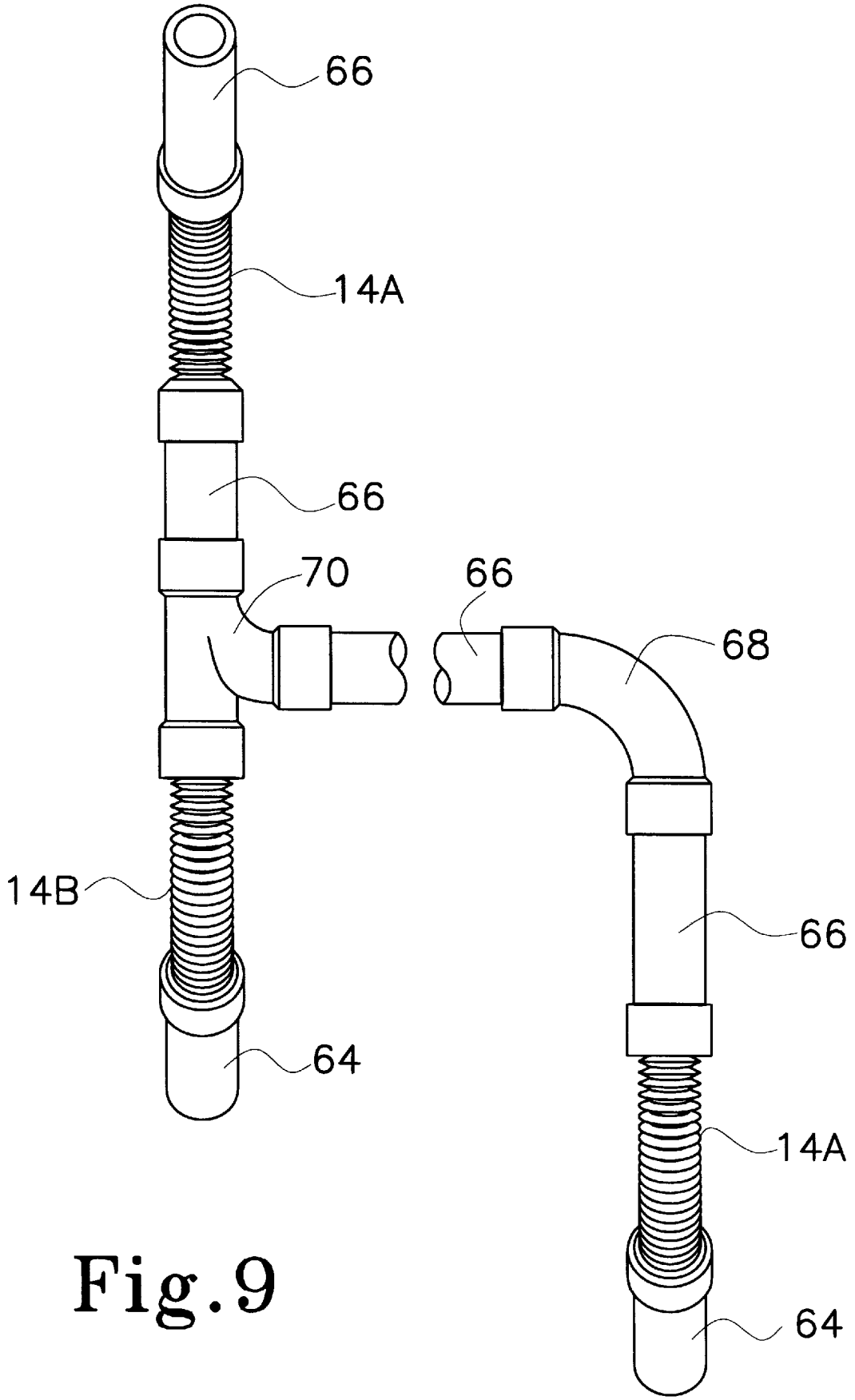
FIG. 9 illustrates an adaptor kit for fluidly connecting two exhaust systems for venting through a ridge vent adaptor of the present invention.

FIG. 9 illustrates an adaptor kit for fluidly connecting two exhaust systems 64 for venting through a ridge vent adaptor 12 of the present invention. Illustrated are two flexible pipe connectors 14A illustrated in FIG. 7 and one flexible pipe connector 14B of FIG. 8. A standard elbow 68 and a T-connector 70 are used to tie the two exhaust systems 64 together. A terminal end of each exhaust system 64 is received in a female receptor 50 of a flexible pipe connector 14A,B. The male connector 54 of the flexible pipe connector 14B is received within the T-connector 70. Due to the flexibility of the flexible pipe connectors 14A,B, the T-connector 70, elbow 68 and those pieces of pipe 66 connected thereto are all disposed in a plane parallel to the pitch of the roof 58.

Illustrated more clearly in FIG. 10 in an adaptor kit including one each of the flexible pipe connectors 14A,B connected with a piece of pipe 66. The flexible pipe connector 14A is connected at one end to the terminal end of an existing exhaust system 64. The male connector 54 of the flexible pipe connector 14B is received within the pipe coupling 34 of the ridge vent adaptor 12. Again, as a function of the flexible pipe connectors 14A,B, the piece of pipe 66 is oriented at an angle (θ) equal to that of the roof pitch. As illustrated, the ridge vent 62 is mounted on the roof 58 in a conventional manner, the ridge vent adaptor 12 being completely concealed. Therefore, it will be seen that there are no modification required to the ridge vent 62, thereby allowing the venting system 10 of the present invention to be used in association with any conventional ridge vent 62.

Figure 11:
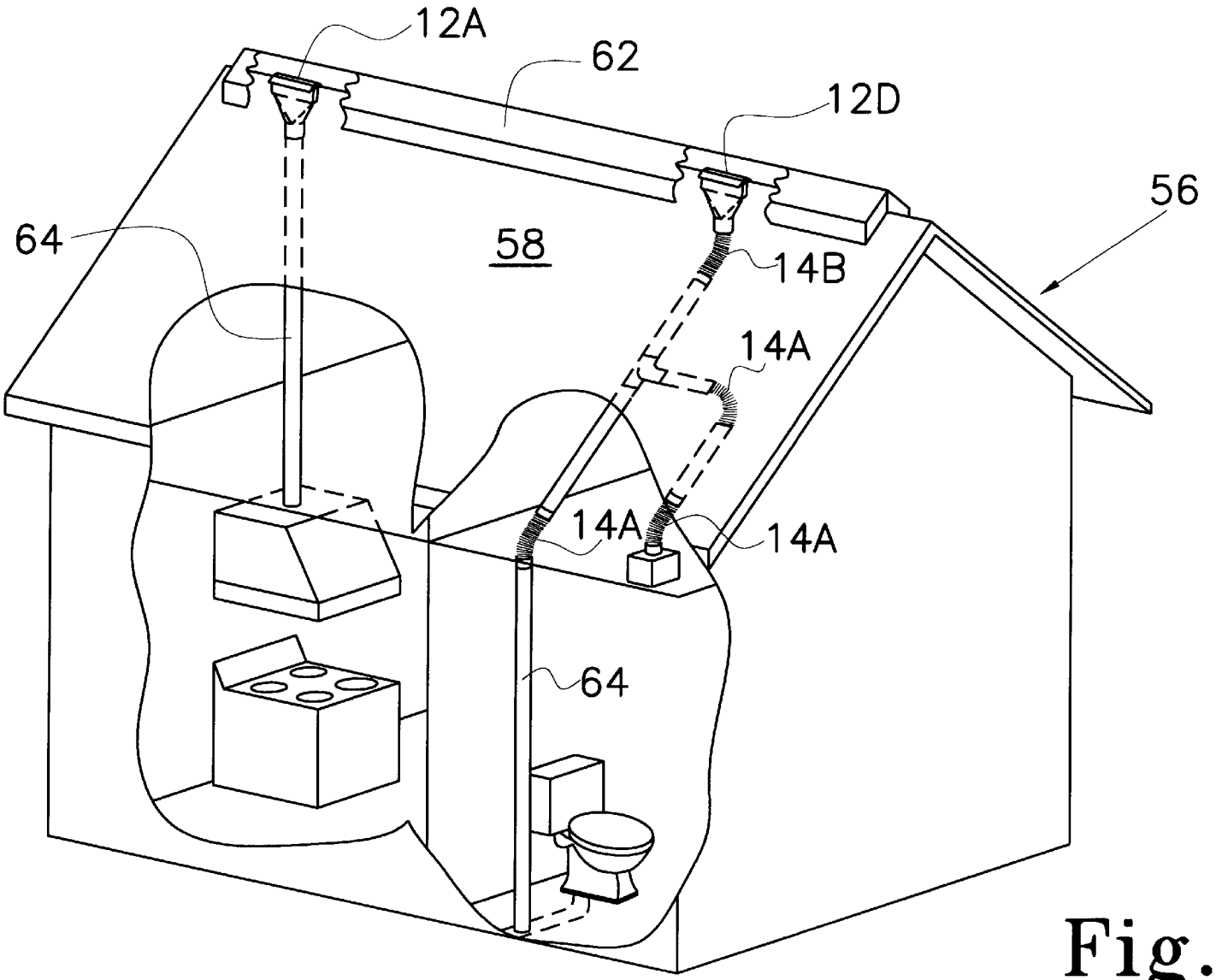
FIG. 11 illustrates the use of the ridge vent adaptor both as a new construction and as a retrofit system.

FIG. 11 illustrates the use of the ridge vent adaptor 12 both as a new construction and as a retrofit system. To illustrate a new construction, the exhaust system 64 of an oven hood is aligned with the ridge of the roof 58. A ridge vent adaptor 12A as illustrated in FIG. 1 is installed during the construction of the roof 58. The materials of manufacture are chosen as sheet metal as leaking through the seams of the ridge vent adaptor 12A is not a concern, as the exhaust is primarily heated air. Of course, it will be understood that in such a system, proper filtering of the air must be accomplished in the filtering system associated with the oven hood.

Also shown is a ridge vent adaptor 12D as illustrated in FIGS. 5 and 6. The ridge vent adaptor 12D is installed after construction of the roof 58 and is used to vent both a sewer exhaust and a room fan exhaust. Because the sewer exhaust is being vented through the ridge vent adaptor 12D, leaking is a concern and the plastic embodiment is chosen accordingly. In either of these situations, it will be seen that other material of fabrication may be chosen with equal success, and again, the present invention is not intended to be limited to those specifically described.

From the foregoing description, it will be recognized by those skilled in the art that a venting system for structures using a ridge vent offering advantages over the prior art has been provided. Specifically, the venting system for structures using a ridge vent provides a means for venting a conventional exhaust system associated with a structure through a conventional ridge vent disposed at a high point on the roof of the structure. Moreover, the venting system is designed for use with various types of exhaust systems, and is designed to be used as a retrofit to an existing structure, or for installation during construction of a new structure. Further, the venting system of the present invention is designed to be easily installed without the assistance of a professional plumber. By utilizing the ridge vent of a structure, the venting system of the present invention eliminates the need for openings cut into the roof of the structure for the passage of a standpipe or other vent, and the disadvantages associated therewith.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A venting system for structures using a ridge vent to exhaust a conventional exhaust system in a structure, said venting system comprising:

a ridge vent adaptor adapted to be disposed on a roof and under a conventional ridge vent, said ridge vent adaptor including a mounting head and a pipe coupling, said mounting head defining a width and a depth, said pipe coupling defining a pipe receptor defining a diameter greater than said mounting head depth and being adapted to receive a terminal end of a pipe and a transition portion configured to be secured to said mounting head, said mounting head being configured to be received within an opening formed in a ridge of a roof of a structure, said mounting head defining a pair of oppositely disposed mounting flaps for securing said mounting head to the roof, said mounting flaps being flexible at least along a top edge of said mounting head.

2. The venting system of claim 1 wherein said transition portion and said pipe coupling are secured one to another as a unit, said transition portion defining an extension for being closely received within said mounting head, said mounting head being securable to said extension, said ridge vent adaptor being provided for retrofitting an existing structure.

3. The venting system of claim 1 wherein said mounting head and said transition portion are fabricated from a sheet metal, and wherein said pipe coupling includes a sleeve fabricated from a sheet metal and a coupling insert closely received in said sleeve and fabricated from plastic.

4. The venting system of claim 1 wherein said ridge vent adaptor is fabricated from plastic.

5. The venting system of claim 1 wherein said mounting flaps are fabricated from a sheet metal and wherein a remainder of said ridge vent adaptor is fabricated from plastic, said mounting flaps being secured within said mounting head.

6. The venting system of claim 1 further comprising:

at least one first flexible pipe connector including a flexible elongated pipe defining first and second ends and a female receptor disposed at each of said first and second ends configured to closely receive an end of a pipe; and at least one second flexible pipe connector including a flexible elongated pipe defining first and second ends, a female receptor disposed at said first end, and a male connector disposed at said second end, said male connector being configured to be closely received within said pipe coupling.

7. The venting system of claim 6 further comprising a pipe configured to be closely received at one end by one of said first flexible pipe connector female receptors and at a second end by said second flexible pipe member female receptor, said pipe being oriented at any selected angle due to a flexibility of said first flexible pipe connector and said second flexible pipe connector.

8. A venting system for structures using a ridge vent to exhaust a conventional exhaust system in a structure, said venting system comprising:

a ridge vent adaptor adapted to be disposed on a roof and under a conventional ridge vent, said ridge vent adaptor including a mounting head and a pipe coupling, said mounting head defining a width and a depth, said pipe coupling defining a pipe receptor defining a diameter greater than said mounting head depth and being adapted to receive a terminal end of a pipe and a transition portion configured to be secured to said mounting head, said mounting head being configured to be received within an opening formed in a ridge of a roof of a structure, said mounting head defining a pair of oppositely disposed mounting flaps for securing said mounting head to the roof, said mounting flaps being flexible at least along a top edge of said mounting head;

at least one first flexible pipe connector including a flexible elongated pipe defining first and second ends and a female receptor disposed at each of said first and second ends configured to closely receive an end of a pipe;

at least one second flexible pipe connector including a flexible elongated pipe defining first and second ends, a female receptor disposed at said first end, and a male connector disposed at said second end, said male connector being configured to be closely received within said pipe coupling; and a pipe configured to be closely received at one end by one of said first flexible pipe connector female receptors and at a second end by said second flexible pipe member female receptor, said pipe being oriented at any selected angle due to a flexibility of said first flexible pipe connector and said second flexible pipe connector.

9. The venting system of claim 8 wherein said transition portion and said pipe coupling are secured one to another as a unit, said transition portion defining an extension for being closely received within said mounting head, said mounting head being securable to said extension, said ridge vent adaptor being provided for retrofitting an existing structure.

10. The venting system of claim 8 wherein said mounting head and said transition portion are fabricated from a sheet metal, and wherein said pipe coupling includes a sleeve fabricated from a sheet metal and a coupling insert closely received in said sleeve and fabricated from plastic.

11. The venting system of claim 8 wherein said ridge vent adaptor is fabricated from plastic.

12. The venting system of claim 8 wherein said mounting flaps are fabricated from a sheet metal and wherein a remainder of said ridge vent adaptor is fabricated from plastic, said mounting flaps being secured within said mounting head.

13. A venting system for structures using a ridge vent to exhaust a conventional exhaust system in a structure, said venting system comprising:

a ridge vent adaptor adapted to be disposed on a roof and under a conventional ridge vent, said ridge vent adaptor including a mounting head and a pipe coupling, said mounting head and said pipe coupling being releasably secured one to another, said pipe coupling defining a pipe receptor adapted to receive a terminal end of a pipe and a transition portion configured to be secured to said mounting head, said mounting head being configured to be received within an opening formed in a ridge of a roof of a structure, said mounting head defining a pair of oppositely disposed mounting flaps for securing said mounting head to the roof, said mounting flaps being flexible at least along a top edge of said mounting head.

14. The venting system of claim 13 wherein said transition portion and said pipe coupling are secured one to another as a unit, said transition portion defining an extension for being closely received within said mounting head, said mounting head being securable to said extension, said ridge vent adaptor being provided for retrofitting an existing structure.

15. The venting system of claim 13 wherein said mounting head and said transition portion are fabricated from a sheet metal, and wherein said pipe coupling includes a sleeve fabricated from a sheet metal and a coupling insert closely received in said sleeve and fabricated from plastic.

16. The venting system of claim 13 wherein said ridge vent adaptor is fabricated from plastic.

17. The venting system of claim 13 wherein said mounting flaps are fabricated from a sheet metal and wherein a remainder of said ridge vent adaptor is fabricated from plastic, said mounting flaps being secured within said mounting head.

18. The venting system of claim 13 further comprising:

at least one first flexible pipe connector including a flexible elongated pipe defining first and second ends and a female receptor disposed at each of said first and second ends configured to closely receive an end of a pipe; and at least one second flexible pipe connector including a flexible elongated pipe defining first and second ends, a female receptor disposed at said first end, and a male connector disposed at said second end, said male connector being configured to be closely received within said pipe coupling.

19. The venting system of claim 18 further comprising a pipe configured to be closely received at one end by one of said first flexible pipe connector female receptors and at a second end by said second flexible pipe member female receptor, said pipe being oriented at any selected angle due to a flexibility of said first flexible pipe connector and said second flexible pipe connector.

* * * * *